US009075344B2

(12) United States Patent
Nagashima

(10) Patent No.: US 9,075,344 B2
(45) Date of Patent: Jul. 7, 2015

(54) IMAGE FORMING APPARATUS AND TONER CONTAINER WITH SHUTTER THAT IS MOVABLE ALONG AN ASSEMBLY DIRECTION OF THE CONTAINER AND PARALLEL TO A CONVEYING SCREW FOR OPENING A TONER DISCHARGE OPENING

(75) Inventor: Teruhiko Nagashima, Osaka (JP)

(73) Assignee: KYOCERA Document Solutions Inc. (JP)

( * ) Notice: Subject to any disclaimer, the term of this patent is extended or adjusted under 35 U.S.C. 154(b) by 476 days.

(21) Appl. No.: 13/445,692

(22) Filed: Apr. 12, 2012

(65) Prior Publication Data

US 2012/0263503 A1 Oct. 18, 2012

(30) Foreign Application Priority Data

Apr. 15, 2011 (JP) ..... 2011-091318

(51) Int. Cl.
*G03G 15/08* (2006.01)

(52) U.S. Cl.
CPC ..... *G03G 15/0877* (2013.01); *G03G 2215/068* (2013.01); *G03G 2215/0692* (2013.01); *G03G 15/0875* (2013.01); *G03G 15/0886* (2013.01); *G03G 15/0893* (2013.01)

(58) Field of Classification Search
CPC ..... G03G 15/0875; G03G 15/0886; G03G 15/0893; G03G 2215/068; G03G 2215/0692
USPC ..... 399/258
See application file for complete search history.

(56) References Cited

U.S. PATENT DOCUMENTS

| | | | | |
|---|---|---|---|---|
| 5,579,101 | A | 11/1996 | Omata et al. | |
| 8,626,036 | B2 * | 1/2014 | Horii et al. | 399/262 |
| 8,639,165 | B2 * | 1/2014 | Tsumita | 399/262 |
| 8,693,925 | B2 * | 4/2014 | Horii et al. | 399/262 |
| 8,693,927 | B2 * | 4/2014 | Morita | 399/263 |
| 8,781,372 | B2 * | 7/2014 | Nagashima | 399/258 |
| 8,811,862 | B2 * | 8/2014 | Nagashima | 399/262 |
| 8,862,029 | B2 * | 10/2014 | Shimizu et al. | 399/119 |
| 8,897,676 | B2 * | 11/2014 | Nakaue et al. | 399/255 |
| 2007/0248384 | A1 * | 10/2007 | Kawai | 399/260 |
| 2008/0063427 | A1 * | 3/2008 | Ikado et al. | 399/106 |

(Continued)

FOREIGN PATENT DOCUMENTS

| | | |
|---|---|---|
| JP | 7-199623 | 8/1995 |
| JP | 2006284661 | 10/2006 |

*Primary Examiner* — David Gray
*Assistant Examiner* — Geoffrey Evans
(74) *Attorney, Agent, or Firm* — Gerald E. Hespos; Michael J. Porco; Matthew T. Hespos

(57) ABSTRACT

A developing device includes a developer housing which includes a container mounting portion and a toner supply opening, a developer shutter plate which is so held on the developer housing as to be movable in a direction parallel to a developing roller and is displaceable to a closing position for closing the toner supply opening and an opening position, and a biasing spring which biases the developer shutter plate to the closing position. The container main body includes a first pressing plate and the developer shutter plate includes an oblique elongated projection with which the first pressing plate comes into contact. The first pressing plate and the oblique elongated projection are formed to displace the developer shutter plate from the closing position to the opening position against a biasing force of the biasing spring as the toner container moves in an assembling direction in a mounting process.

6 Claims, 9 Drawing Sheets

(56) References Cited

U.S. PATENT DOCUMENTS

| | | | | |
|---|---|---|---|---|
| 2012/0263504 | A1* | 10/2012 | Nagashima | 399/262 |
| 2013/0101317 | A1* | 4/2013 | Shimizu et al. | 399/258 |
| 2013/0101318 | A1* | 4/2013 | Shimizu et al. | 399/258 |
| 2013/0136497 | A1* | 5/2013 | Morita et al. | 399/119 |
| 2013/0243492 | A1* | 9/2013 | Shimizu et al. | 399/260 |
| 2014/0140737 | A1* | 5/2014 | Yamanaka | 399/260 |
| 2014/0147175 | A1* | 5/2014 | Makie et al. | 399/263 |
| 2014/0348548 | A1* | 11/2014 | Kawarago | 399/260 |
| 2015/0093154 | A1* | 4/2015 | Yoshii et al. | 399/263 |

* cited by examiner

IMAGE FORMING APPARATUS AND TONER CONTAINER WITH SHUTTER THAT IS MOVABLE ALONG AN ASSEMBLY DIRECTION OF THE CONTAINER AND PARALLEL TO A CONVEYING SCREW FOR OPENING A TONER DISCHARGE OPENING

This application is based on Japanese Patent Application Serial No. 2011-091318 filed with the Japan Patent Office on Apr. 15, 2011, the contents of which are hereby incorporated by reference.

BACKGROUND

The present disclosure relates to an image forming apparatus including a developing device for developing an electrostatic latent image formed on a photoconductor with toner and a toner container for storing toner and supplying the toner to the developing device, and the toner container.

There is known an image forming apparatus such as a printer in which a developing device is arranged around a photosensitive drum and an electrostatic latent image formed on the photosensitive drum is developed with toner by this developing device. A toner container is removably assembled with the developing device, and toner is supplied from the toner container to the developing device as the toner decreases in amount.

As a developing device including a toner container of this type, the developing device disclosed in this prior art includes a cylindrical toner container mounting portion extending in parallel to an axial direction of a developing roller, and a toner container containing toner to be supplied is removably mounted to this toner container mounting portion. In mounting the toner container, a user rotates the toner container in a specific direction after inserting the toner container into the toner container mounting portion from one end of the toner container mounting portion. By this rotation, a toner supply opening of the developing device and a toner discharge opening of the toner container are aligned, and a shutter member closing the toner supply opening moves in a circumferential direction along the inner circumferential surface of the toner container mounting portion. As a result, the toner can be supplied from the toner container to the developing device.

Note that, with many of conventional image forming apparatuses, directions parallel to axial directions of a photosensitive drum and a developing roller are forward and backward directions and a user performs various operations while standing in front of the apparatus.

In recent years, directions perpendicular to an axial direction of a developing roller have been forward and backward directions of an apparatus in some of image forming apparatuses such as small-size printers. In the image forming apparatus of this type, a structure for assembling a toner container with a developing device from the front side of the apparatus (in a horizontal direction perpendicular to the axial direction of the developing roller) is thought in terms of easier mounting and removal of the toner container.

A conventional structure including a toner container and the like cannot be directly applied to an image forming apparatus of this type. Particularly, it is difficult to open and close a shutter member of a developing device by rotating a toner container once housed in the apparatus from the outside of the apparatus. Accordingly, there is a need for another structure for opening and closing the shutter member as the toner container is mounted and removed.

The present disclosure was developed in view of the above situation and relates to an image forming apparatus in which a toner container is mounted to and removed from a developing device along a direction perpendicular to an axial direction of a developing roller and an object thereof is to enable a shutter member of the developing device to be appropriately opened and closed as the toner container is mounted to and removed from the developing device.

SUMMARY

To achieve the above object, one aspect of the present disclosure is directed to an image forming apparatus, comprising an image bearing member (31) for bearing a toner image on a circumferential surface, a developing device (33) including a developing roller (331) for supplying toner to the circumferential surface of the image bearing member (31), and a toner container (50) to be removably assembled with the developing device for supplying toner to the developing device (33). The toner container (50) includes a container main body (51) provided with a toner discharge opening (511) at a predetermined position and is assembled with the developing device along an assembling direction perpendicular to an axial direction of the developing roller (331). The developing device (33) includes a housing main body (60) in which the developing roller (331) is housed and which includes a toner supply opening (60H) for receiving the toner from the toner container (50), a container mounting portion (61) which is arranged on the housing main body (60) and on which the toner container is to be mounted, a shutter member (62) which is so held on the housing main body as to be displaceable in a direction parallel to the axial direction of the developing roller and is displaceable to a first position (FIG. 7) for closing the toner supply opening (60H) and a second position (FIG. 8) for opening the toner supply opening (60H), and a biasing member (625) which biases the shutter member (62) to the first position. The container main body (51) includes a container side first contact portion (542) and the shutter member (62) includes a shutter member side contact portion (622). The container side first contact portion (542) comes into contact with the shutter member side contact portion (622) in a mounting process of mounting the toner container (50) to the container mounting portion (61) of the developing device (33). The container side first contact portion (542) and the shutter member side contact portion (622) are formed to displace the shutter member (62) from the first position (FIG. 7) to the second position (FIG. 8) against a biasing force of the biasing member (625) as the toner container (50) moves in the assembling direction in the mounting process.

Further, another aspect of the present disclosure is directed to a toner container to be assembled with a developing device. The toner container (50) is removably mountable to the developing device including a developing roller (331) for supplying toner to a circumferential surface of an image bearing member (31) bearing a toner image on the circumferential surface along a direction (referred to as an assembling direction) perpendicular to an axial direction of the developing roller 331. The developing device includes a housing main body (60) which includes a container mounting portion (61) on which the toner container is to be mounted, and a toner supply opening (60H) for receiving the toner from the toner container (50) mounted to the container mounting portion; a shutter member (62) which is so held on the housing main body as to be displaceable in a direction parallel to the axial direction of the developing roller (331) and is displaceable to a first position for closing the toner supply opening (60H) and a second position for opening the toner supply opening (60H); and a biasing member (625) which biases the shutter member (62) to the first position. The toner container comprises a container main body (51) in which toner is contained and which is provided with a toner discharge opening (511) through which the toner is to be supplied to the developing device (33). The container main body (51) includes a contact portion (542) which comes into contact with the shutter member (62) in a mounting process of mounting the toner container (50) to the container mounting portion (61). The contact portion (542) is formed to displace the shutter member (62) from the first position to the second position against a biasing force of the biasing member (625) as the toner container (50) moves in the assembling direction in the mounting process.

These and other objects, features and advantages of the present disclosure will become more apparent upon reading the following detailed description along with the accompanying drawings.

DETAILED DESCRIPTION

Figure 1:
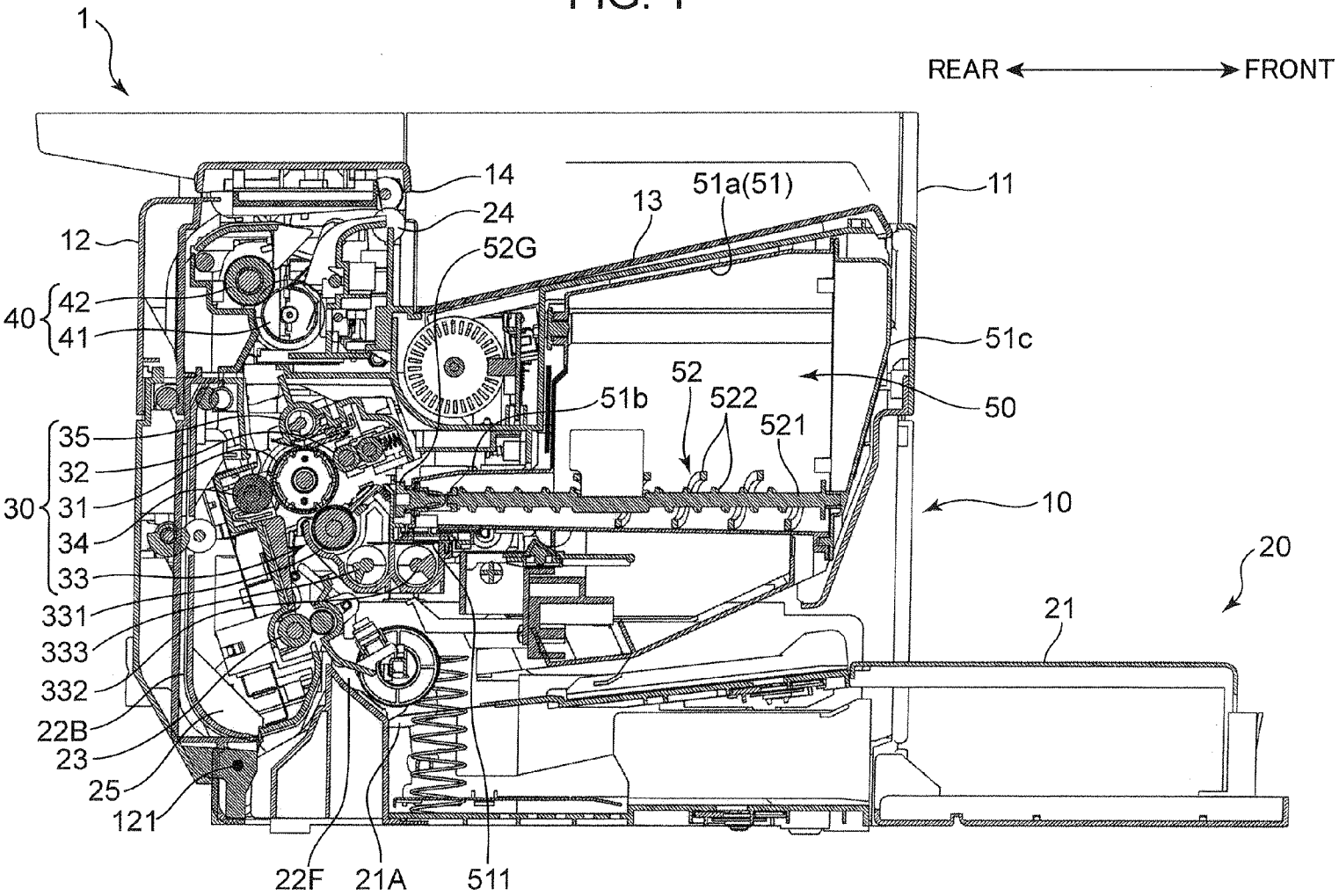
FIG. 1 is a sectional view showing the internal structure of an image forming apparatus according to one embodiment of the present disclosure.

Hereinafter, an embodiment of the present disclosure is described in detail based on the drawings. FIG. 1 is a sectional view showing the internal structure of an image forming apparatus 1 according to one embodiment of the present disclosure. Although a black-and-white printer is illustrated as the image forming apparatus 1 here, the image forming apparatus may be a printer, a facsimile machine or a complex machine provided with these functions or may be an image forming apparatus for forming a color image.

The image forming apparatus 1 includes a main housing 10 having a substantially rectangular parallelepipedic housing structure, a feeding unit 20, an image forming unit 30, a fixing unit 40 and a toner container 60 housed in the main housing 10.

The main housing 10 includes a front cover 11 on the front side (right side of FIG. 1) and a rear cover 12 on the rear side. A user can take out the toner container 50 from the front side of the main housing 10 by opening the front cover 11 when toner runs out. The rear cover 12 is a cover which is opened at the time of a sheet jam and maintenance. The respective units such as the image forming unit 30 and the fixing unit 40 can be taken out from the rear side of the main housing 10 by opening the rear cover 12. Further, a sheet discharge unit 13 to which a sheet after image formation is to be discharged is provided on the upper surface of the main housing 10.

The feeding unit 20 includes a sheet cassette 21 for storing sheets on which an image forming operation is to be performed. This sheet cassette 21 can be withdrawn forward from the front side of the main housing 10. The sheet cassette 21 includes a sheet storage space where a stack of sheets is stored, a lift plate for lifting up the stack of sheets for sheet feeding, and the like. A sheet feeding portion 21A is provided above the rear end of the sheet cassette 21. A pickup roller (not shown) for picking up the uppermost sheet of the sheet stack in the sheet cassette 21 one by one is arranged in this sheet feeding portion 21A.

The image forming unit 30 performs an image forming process of forming a toner image on a sheet fed from the feeding unit 20. The image forming unit 30 includes a photosensitive drum 31 (referred to as an image bearing member), and a charger 32, an exposure device (not shown in FIG. 1), a developing device 33, a transfer roller 34 and a cleaner 35 arranged around the photosensitive drum 31.

The photosensitive drum 31 rotates about its shaft and has an electrostatic latent image and a toner image formed on its circumference surface. A photosensitive drum made of an amorphous silicon (a-Si) material can be used as the photosensitive drum 31. The charger 32 uniformly charges the circumferential surface of the photosensitive drum 31 and includes a charging roller held in contact with the photosensitive drum 31. The exposure device includes a laser light source and optical devices such as mirrors and lenses and forms an electrostatic latent image by irradiating the circumferential surface of the photosensitive drum 31 with light modulated based on image data fed from an external apparatus such as a personal computer.

The developing device 33 supplies toner to the circumferential surface of the photosensitive drum 31 to develop an electrostatic latent image on the photosensitive drum 31 and form a toner image. The developing device 33 includes a developing roller 331 for bearing the toner to be supplied to the photosensitive drum 31 and a first and a second conveying screws 332, 333 for conveying developer (toner) in a circulating manner in a developer housing 60 (see FIGS. 2 to 5; referred to as a housing main body) while agitating the developer. This developing device 33 is described in detail later.

The transfer roller 34 is a roller for transferring a toner image formed on the circumferential surface of the photosensitive drum 31 to a sheet and a nip portion is formed between the transfer roller 34 and the photosensitive drum 31. A transfer bias having a polarity opposite to that of the toner is applied to this transfer roller 34. The cleaner 35 includes a cleaning roller and the like and cleans the circumferential surface of the photosensitive drum 31 after the transfer of a toner image.

The fixing unit 40 performs a fixing process of fixing a transferred toner image to a sheet. The fixing unit 40 includes a heating roller 41 including a heat source inside and a pressure roller 42 pressed in contact with this fixing roller 41 and forming a fixing nip portion together with the heating roller 41. When a sheet having a toner image transferred thereto passes the fixing nip portion, the toner image is fixed to the sheet by being heated by the heating roller 41 and pressed by the pressure roller 42.

The toner container 50 is for storing the toner to be supplied to the developing device 33. The toner container 50 includes a container main body 51 in which the toner is contained and a conveying screw 52 for conveying the toner contained in the container.

Figure 6:
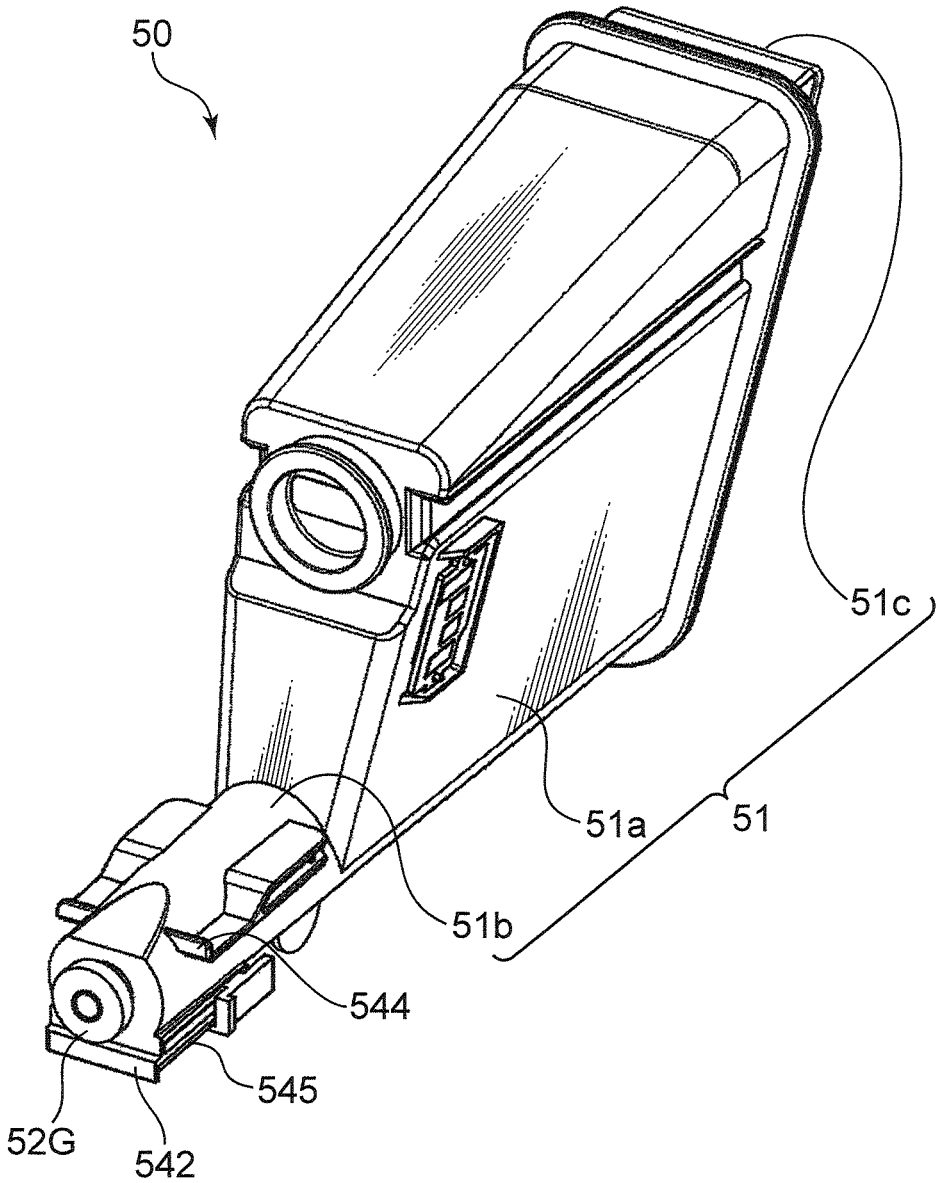
FIG. 6 is a perspective view of the toner container alone.

The container main body 51 includes a toner containing portion 51*a* in which the toner is mainly stored, a cylindrical portion 51*b* projecting from a lower part of one side surface (rear surface in FIG. 1) of this toner containing portion 51*a*, and a lid member 51*c* for covering another side surface of the toner containing portion 51*a* (see FIG. 6). The conveying screw 52 includes a shaft 521 extending in an arrangement direction of the toner containing portion 51*a* and the cylindrical portion 51*b* and a blade portion 522 spirally projecting on the outer periphery of this shaft 521. The toner stored in the toner container 50 is conveyed from the toner containing portion 51*a* to the cylindrical portion 51*b* by driving and rotating the conveying screw 52 and supplied into the developing device 33 through a toner discharge opening 511 provided in the lower surface of the leading end of the cylindrical portion 51*b*. The detailed construction of this toner container 50 is described in detail later.

A main conveyance path 22F and a reversing conveyance path 22B are provided in the main housing 10 to convey a sheet. The main conveyance path 22F extends from the sheet feeding portion 21A of the feeding unit 20 to a sheet discharge port 14 provided to face the sheet discharge unit 13 on the upper surface of the main housing 10 via the image forming unit 30 and the fixing unit 40. The reversing conveyance path 22B is a conveyance path for returning a sheet having one side printed to a side of the main conveyance path 22F upstream of the image forming unit 30 in the case of printing both sides of the sheet.

A pair of registration rollers 23 are arranged at a position of the main conveyance path 22F upstream of the transfer nip portion between the photosensitive drum 31 and the transfer roller 34. A sheet is temporarily stopped by the pair of registration rollers 23 and fed to the transfer nip portion at a predetermined timing for image transfer after a skew correction. A plurality of conveyor rollers for conveying a sheet are arranged at suitable positions of the main conveyance path 22F and the reversing conveyance path 22B. For example, a pair of discharge rollers 24 are arranged near the sheet discharge port 14.

The reversing conveyance path 22B is formed between the outer surface of a reversing unit 25 and the inner surface of the rear cover 12 of the main housing 10. Note that the transfer roller 34 and one of the pair of registration rollers 23 are mounted on the inner surface of the reversing unit 25. The rear cover 12 and the reversing unit 25 are respectively rotatable about an axis of a supporting point portion 121 provided at the lower ends thereof. If a sheet jam occurs in the reversing conveyance path 22B, the rear cover 12 is opened. If a sheet jam occurs in the main conveyance path 22F or if a unit including the photosensitive drum 31 or the developing device 33 is taken out, the reversing unit 25 is opened in addition to the rear cover 12.

Figure 2:
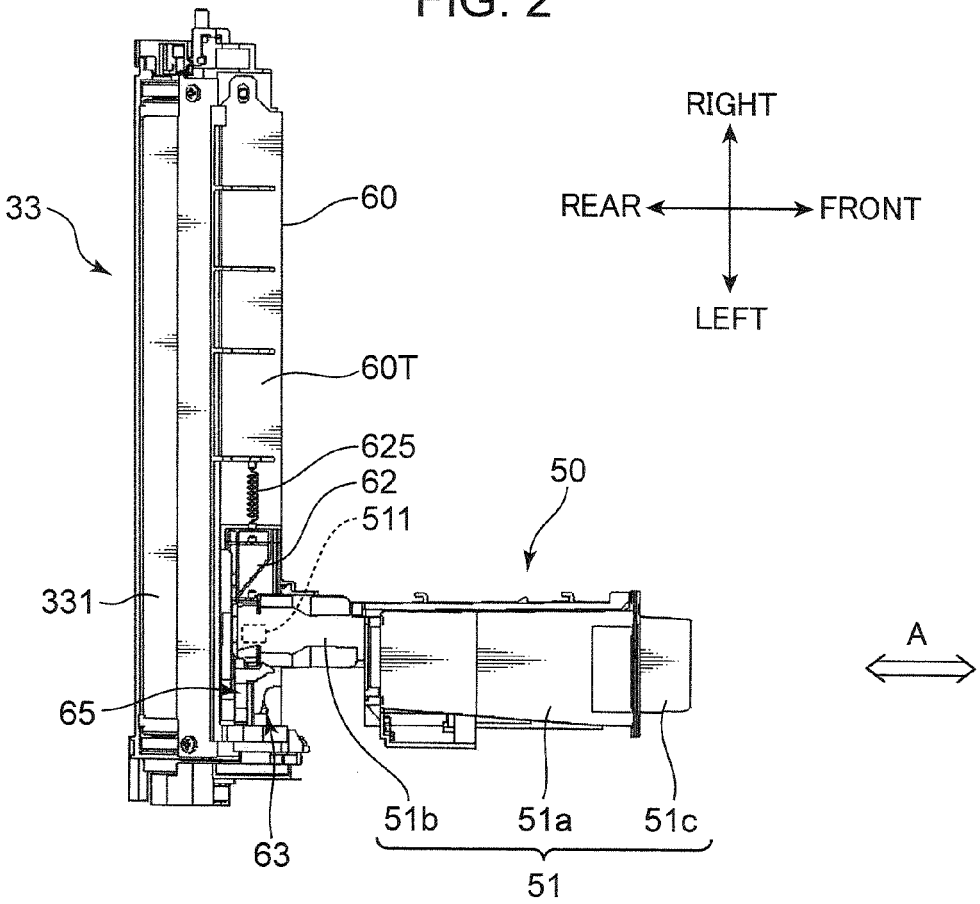
FIG. 2 is a plan view showing a developing device and a toner container incorporated in the image forming apparatus.
Figure 3:
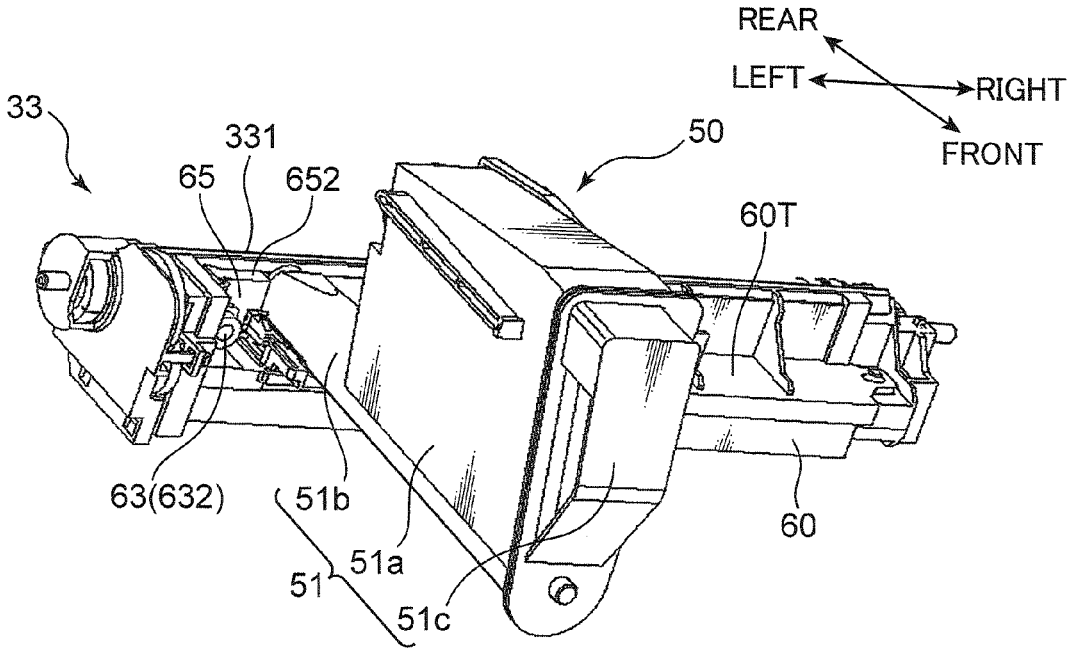
FIG. 3 is a perspective view of the developing device and the toner container shown in FIG. 2.
Figure 4:
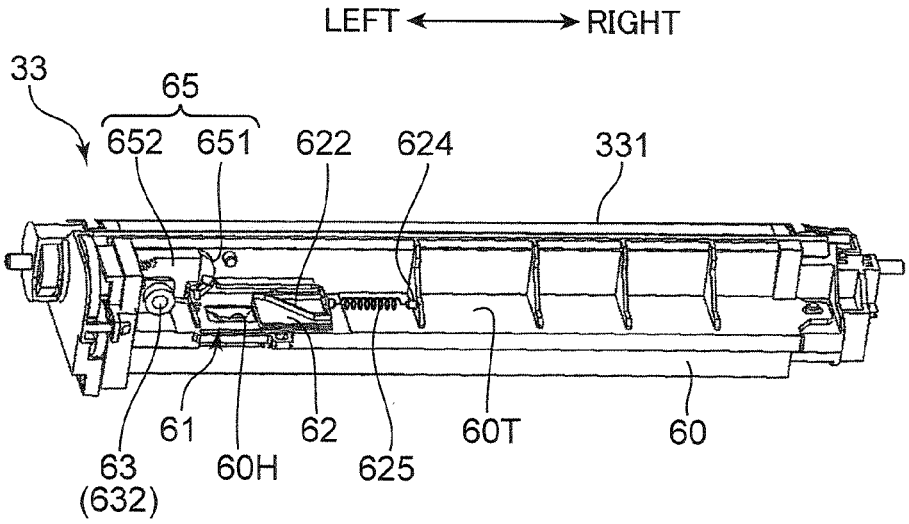
FIG. 4 is a perspective view of the developing device alone.
Figure 7:
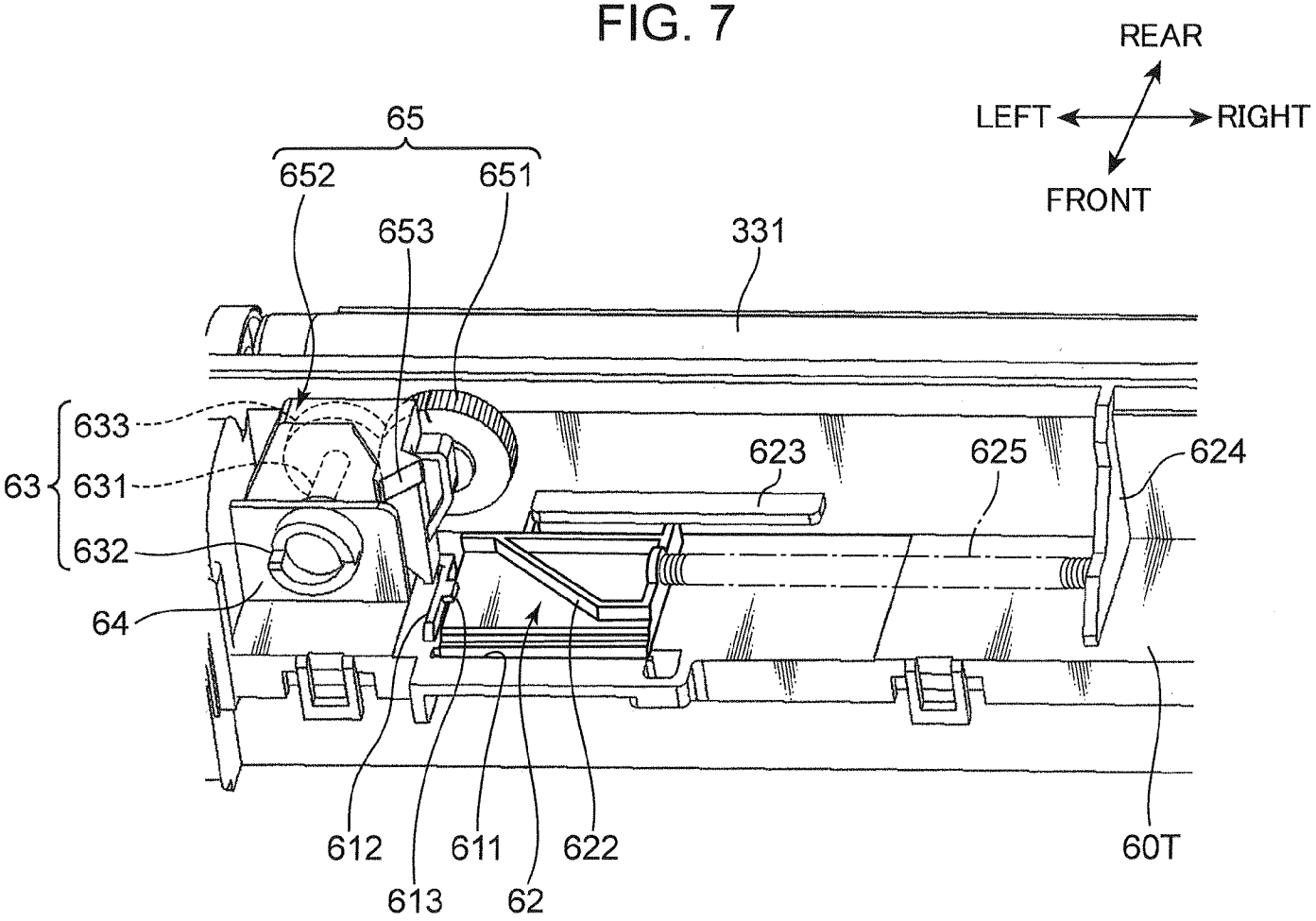
FIG. 7 is an enlarged view of an essential part of the developing device showing a container mounting portion and its vicinity (state where a developer shutter plate is at a closing position)
Figure 8:
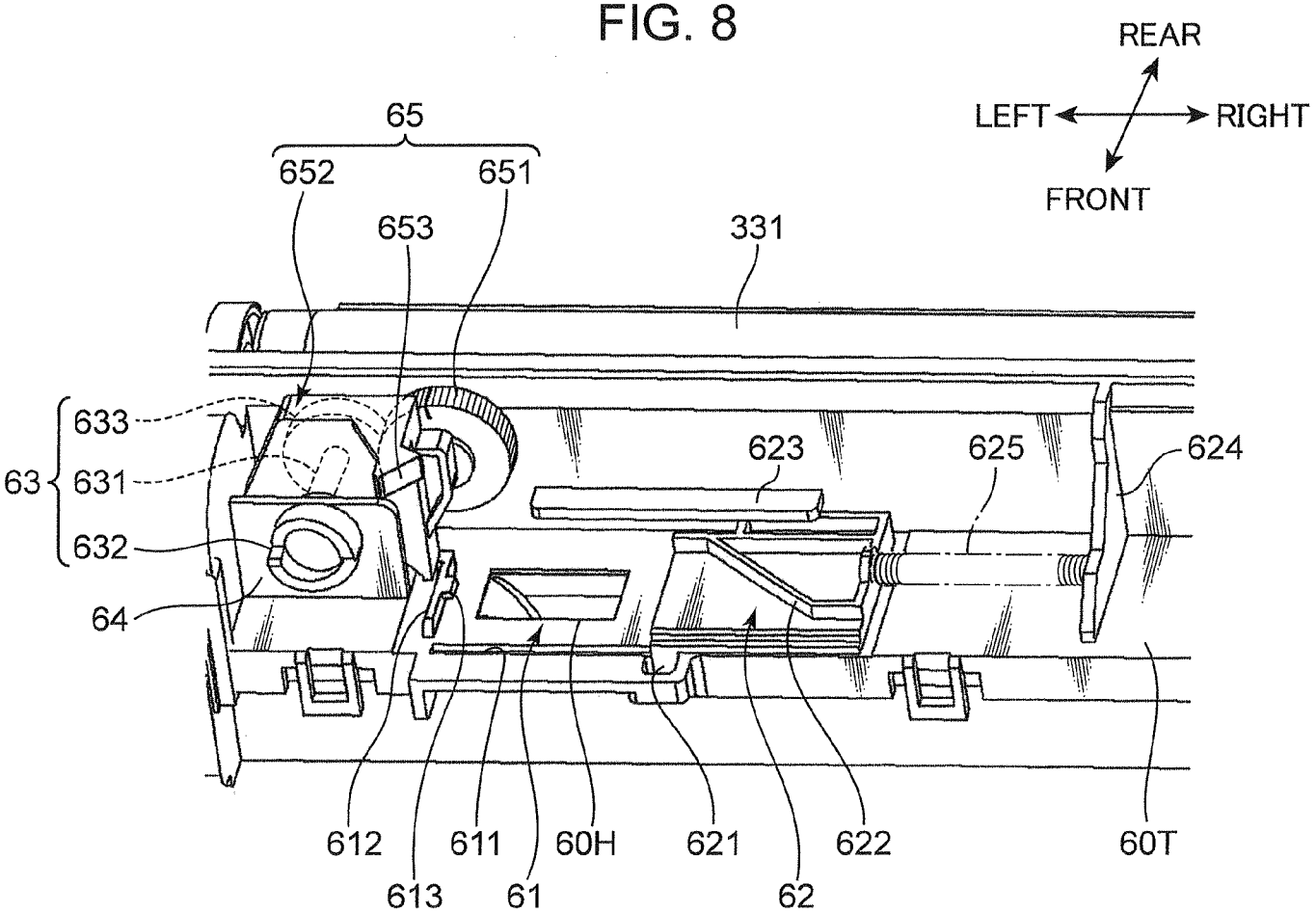
FIG. 8 is an enlarged view of the essential part of the developing device showing the container mounting portion and its vicinity (state where the developer shutter plate is at an opening position)
Figure 9:
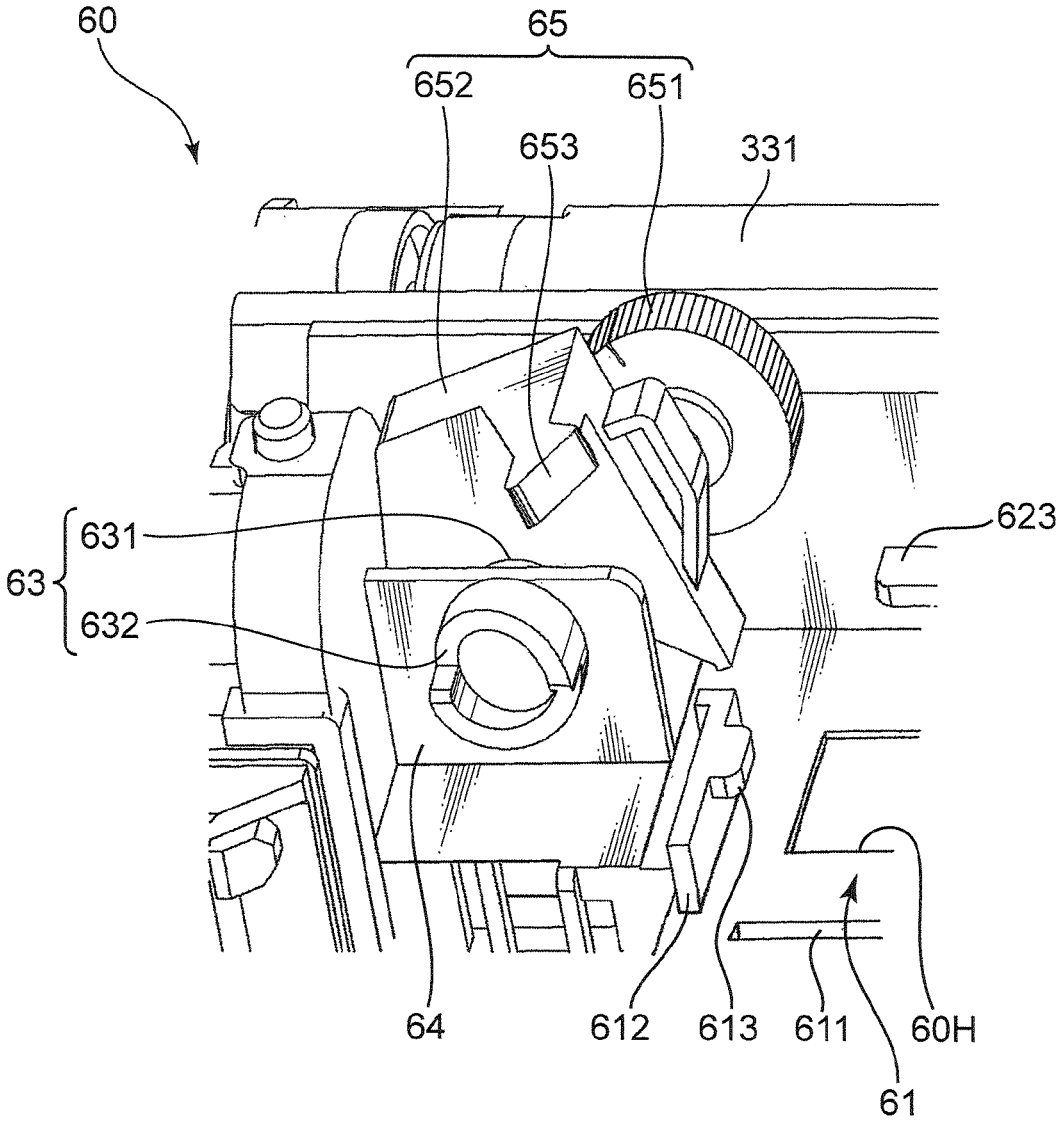
FIG. 9 is an enlarged view of an essential part of the developing device showing a state where a gear holder is at a retracted position.
Figure 10:
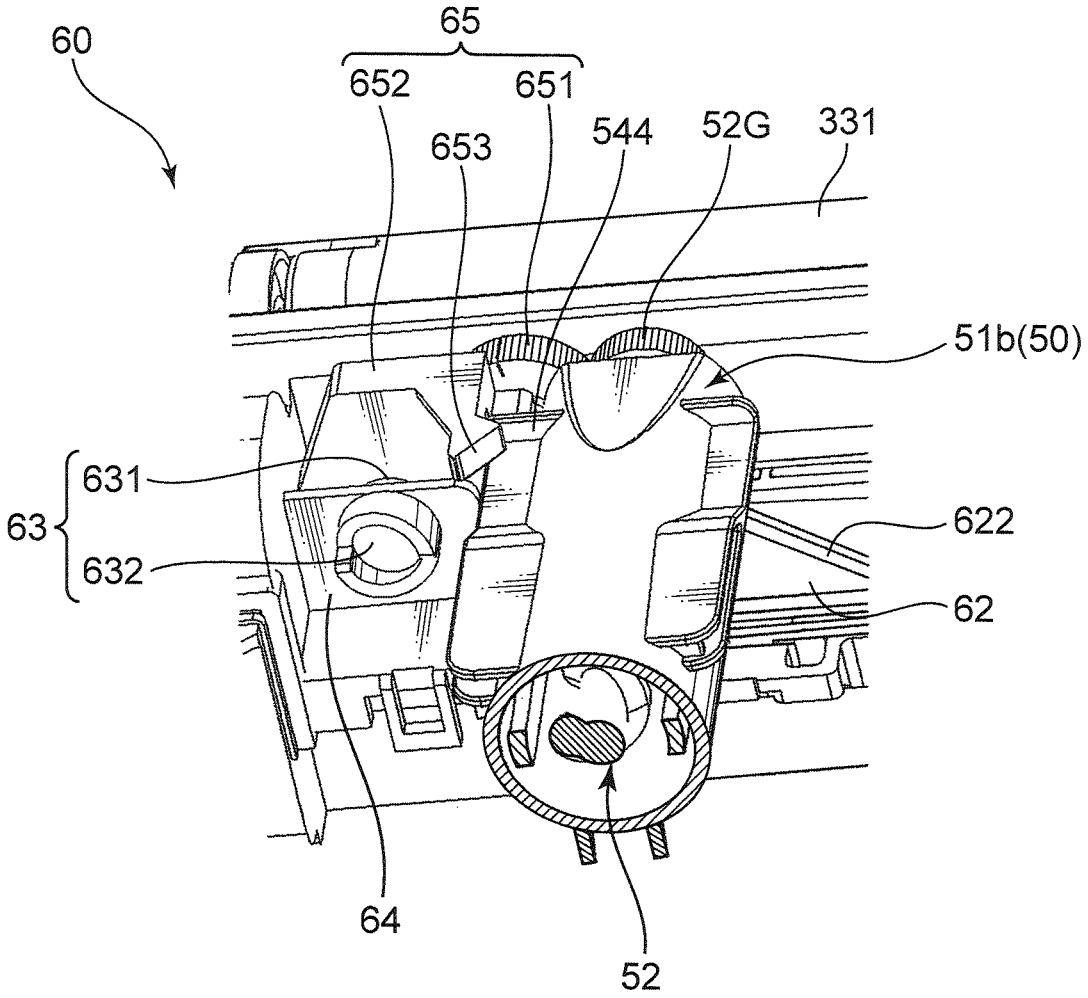
FIG. 10 is an enlarged view showing an essential part of the developing device and the toner container showing a state where the toner container is assembled.

Next, the structures of the developing device 33 and the toner container 50 are described with reference to FIGS. 2 to 11. FIG. 2 is a plan view showing an assembled state of the developing device 33 and the toner container 50, FIG. 3 is a perspective view showing the state of FIG. 2, FIG. 4 is a perspective view of the developing device 33 alone, FIG. 5 is a plan view showing the internal structure of the developing device 33, FIG. 6 is a perspective view of the toner container 50 alone, FIGS. 7 to 9 are enlarged views of an essential part of the developing device 33, FIG. 10 is an enlarged view showing an essential part of the developing device 33 and the toner container 50 showing a state where the toner container 50 is assembled with the developing device 33, and FIG. 11 are diagrams of the developing device 33 and the toner container 50 respectively showing a process of assembling the toner container 50 with the developing device 33.

The developing device 33 includes the developer housing 60 having a box shape long in one direction (axial direction of the developing roller 331). The developer housing includes an opening extending in a longitudinal direction thereof, and a part of the circumferential surface of the developing roller 331 is exposed through this opening. In this embodiment, the developer housing 60 is so assembled into the main housing 10 that the longitudinal direction thereof is aligned with a lateral direction of the main housing 10.

Figure 5:
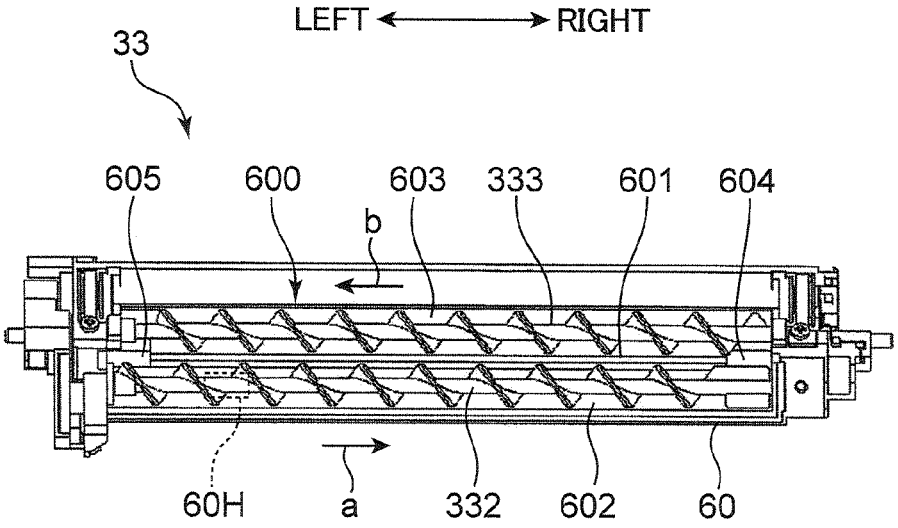
FIG. 5 is a plan view showing the internal structure of the developing device.

With reference to FIG. 5, the developer housing 60 includes an internal space 600. In the case of a two-component developing method, developer composed of toner and carrier is filled in this internal space 600. The carrier is agitated and mixed with the toner in the internal space 600, thereby charging the toner and conveying the toner to the developing roller 331. The toner is successively supplied to the developing roller 331 to be consumed, and the amount of the toner corresponding to the consumed amount is appropriately supplied from the toner container 50.

The internal space 600 of the developer housing 60 is partitioned into a first passage 602 and a second passage 603 long in the lateral direction by a partition plate 601 extending in the lateral direction. The partition plate 601 is shorter than the width of the developer housing 60 in the lateral direction, and a first communicating portion 604 and a second communicating portion 605 for allowing the first passage 602 and the second passage 603 to communicate are provided at the right and left ends of the partition plate 601. In this way, a circulation path composed of the first passage 602, the first communicating portion 604, the second passage 603 and the second communicating portion 605 is formed in the developer housing 60.

The first conveying screw 332 is housed in the first passage 602, and the second conveying screw 333 is housed in the second passage 603. Each of the first and second conveying screws 332, 333 includes a shaft and a blade portion spirally projecting on the outer periphery of this shaft. The first conveying screw 332 is driven and rotated about the shaft, thereby conveying the developer in a direction of an arrow "a" of FIG. 5. On the other hand, the second conveying screw 333 is driven and rotated about the shaft, thereby conveying the developer in a direction of an arrow "b". Accordingly, the developer is conveyed in a circulating manner along the above circulation path by driving and rotating the first and second conveying screws 332, 333.

With reference to FIGS. 4 and 7, a container mounting portion 61 is provided near the left end of a ceiling plate 60T of the developer housing 60. This container mounting portion 61 is perforated with a toner supply opening 60H used to receive the toner supplied from the toner container 50 into this housing 60, and this toner supply opening 60H and the toner discharge opening 511 of the toner container 50 are aligned in a vertical direction with the toner container 50 mounted to the container mounting portion 61.

The toner supply opening 60H is located above the vicinity of the left end of the first passage 602 of the developer housing 60. Accordingly, the toner newly supplied through the toner supply opening 60H falls down to the first passage 602, is mixed with the existing developer and conveyed in the direction of the arrow "a" by the first conveying screw 332. At this time, the toner is agitated with the carrier to be charged. Subsequently, the toner reaches the second passage 603 from the downstream end of the first passage 602 via the first communicating portion 604 and is conveyed in the direction of the arrow "b" by the second conveying screw 333. During this conveyance, the toner is similarly charged and, on the other hand, a part thereof is supplied to the circumferential surface of the developing roller 331. The remaining toner and the carrier are returned to the upstream end of the first passage 602 via the second communicating portion 605.

A developer shutter plate 62 (referred to as a shutter member) slidable in the lateral direction is arranged on the upper surface of the ceiling plate 60T of the developer housing 60. The developer shutter plate 62 is located on the container mounting portion 61 and slidable to a closing position for closing the toner supply opening 60H by covering the toner supply opening 60H (position shown in FIG. 7; referred to as a first position of the present disclosure) and an opening position reached by moving rightward from the closing position to open the toner supply opening 60H (position shown in FIGS. 4 and 8; referred to as a second position of the present disclosure).

The developer shutter plate 62 includes a guiding projection 621 projecting downward. This guiding projection 621 is inserted in a slit-like guide groove 611 formed in the ceiling plate 60T and extending in the lateral direction. Further, the ceiling plate 60T is formed with a rib 623 extending in the lateral direction and covering a part of the developer shutter plate 62 from above. In this way, the developer shutter plate 62 stably slides in the lateral direction along the guide groove 611 while being pressed by the rib 623 from above.

The developer shutter plate 62 is constantly biased leftward, i.e. to be located at the closing position by a biasing spring 625 (referred to as a biasing member). The biasing spring 625 is a coil spring and the respective ends thereof are mounted on unillustrated spring seats provided on the right end edge of the developer shutter plate 62 and a rib 624 adjacent to the developer shutter plate 62.

An oblique elongated projection 622 (referred to as a shutter member side contact portion) inclined in an oblique direction with respect to forward and backward directions is provided on the upper surface of the developer shutter plate 62. This oblique elongated projection 622 translates an external force applied to this oblique elongated projection 622 from the front side, i.e. a pressing force at the time of assembling the toner container 50 with the developing device 33 into a thrust force for moving the developer shutter plate 62 rightward (to the right in FIG. 7), i.e. a force for displacing the developer shutter plate 62 from the first position to the second position. Note that, in this embodiment, the front surface of the oblique elongated projection 622 corresponds to an oblique surface of the present disclosure.

A guiding portion 612 of the toner container 50 is arranged on the left side of the container mounting portion 61 of the developer housing 60. The guiding portion 612 guides the toner container 50 at the time of mounting the toner container 50 to the container mounting portion 61, and is composed of an elongated projection projecting from the upper surface of the ceiling plate 60T of the developer housing 60 and extending in forward and backward directions.

A shaft member 63, a gear holder 65 and an unillustrated biasing spring for transmitting a rotational drive force from an unillustrated motor to the toner container 50 are further arranged to the left of this guiding portion 612.

The shaft member 63 includes a rotary shaft 631 which extends in forward and backward directions and is rotatably supported on a supporting portion 64 arranged on the ceiling plate 60T, a coupling 632 which is fixed to one end (front side in FIG. 7) of this rotary shaft 631 and to which the rotational drive force from the motor is given, and an intermediate gear 633 which is a spur gear fixed to the other end of the rotary shaft 631.

The gear holder 65 includes a holder main body 652 which is pivotably supported on the rotary shaft 631 of the shaft member 63, and an output gear 651 which is a spur gear rotatably supported on the holder main body 652 while being engaged with the intermediate gear 633. The gear holder 65 is pivotable to an engaged position (shown in FIG. 7) where the output gear 651 is engaged with a later-described container gear 52G of the toner container 50 mounted to the container mounting portion 61 and a retracted position (position shown in FIG. 9) where the output gear 651 is retracted outward (leftward) from the engaged position. The gear holder 65 is biased by a biasing spring to be constantly located at the engaged position. This biasing spring (referred to as a gear holder biasing member) is a torsion coil spring and mounted on the rotary shaft 631 at a position between the supporting portion 64 and the gear holder 65, and both ends thereof are engaged with the supporting portion 64 and the holder main body 652.

Note that a transmission gear 651 of the gear holder 65 and the intermediate gear 633 of the shaft member 63 decelerate the rotational speed of the rotational drive force given from the motor to the shaft member 63 to a predetermined rotational speed to be applied to the toner container 50.

The holder main body 652 of the gear holder 65 is formed with a contact portion 653 (referred to as a gear holder side contact portion) with which the toner container 50 comes into contact at the time of mounting the toner container 50 to the container mounting portion 61. This contact portion 653 has a contact surface inclined in an oblique direction with respect to forward and backward directions so that an external force given to the contact portion 653 from the front side can be translated into a leftward (leftward when viewed from front) rotational force of the gear holder 65, i.e. a force for displaying the gear holder 65 from the engaged position to the retracted position.

The toner container 50 is assembled with the developing device 33 from the side of the cylindrical portion 51*b* along a direction (forward and backward directions/assembling direction) perpendicular to a longitudinal direction of the developer housing 60 as shown by an arrow A in FIG. 2 with the toner containing portion 51*a* and the cylindrical portion 51*b* arranged in forward and backward directions. Accordingly, with the toner container 50 mounted to the developing device 33, the toner in the container is supplied to the developing device 33 while being conveyed from the front side to the rear side as the conveying screw 52 is rotated.

A first pressing plate 542 (referred to as a container side first contact portion) for pressing the developer shutter plate 62 of the developer housing 60 is mounted on a lower part of the leading end edge of the cylindrical portion 51*b* of the toner container 50, and a second pressing plate 544 (referred to as a container side second contact portion) for pressing the holder main body 652 of the gear holder 65 is mounted on the right side of the cylindrical portion 51*b* slightly behind the leading end of the cylindrical portion 51*b*. Further, the container gear 52G which is a spur gear used to input the rotational drive force of the conveying screw 52 is arranged and exposed on the leading end surface of the cylindrical portion 51*b*. This container gear 52G is arranged on the same axial line as the shaft 521 of the conveying screw 52 and coupled to the leading end of the shaft 521 so as to be integrally rotatable with the shaft 521.

In mounting the toner container 50 to the developing device 33, the user inserts the toner container 50 into the image forming apparatus 1 from front and assembles it with the container mounting portion 61 of the developer housing 60. At this time, the user inserts a projection 613 formed on the guiding portion 612 into a groove portion 545 (see FIG. 6) formed at a lateral portion of the cylindrical portion 51*b* and inserts the toner container 50 to a predetermined assembled position along the guiding portion 612.

When being inserted into the container mounting portion 61 from the front side to the rear side, the cylindrical portion 51*b* of the toner container 50 interferes with the gear holder 65 arranged at the engaged position and the gear holder 65 is moved to the retracted position (see FIG. 9; toner container 50 is not shown in FIG. 9). Specifically, the second pressing plate 544 comes into contact with the contact surface of the contact portion 653 from front, whereby the gear holder rotates to the left (to the left when viewed from front) about the rotary shaft 631 of the gear holder 65 against a biasing force of the biasing spring. In this way, the interference of the container gear 52G on the leading end of the cylindrical portion 51*b* and the output gear 651 of the developing device 33 is avoided.

When the toner container 50 is inserted to the predetermined assembled position, the second pressing plate 544 passes the position of the contact portion 653 as shown in FIG. 10, whereby a contact state of the second pressing plate 544 and the contact portion 653 is released and the gear holder 65 returns to the engaged position by the biasing force of the biasing spring. In this way, the output gear 651 is engaged with the container gear 52G and the rotational drive force can be transmitted from the developing device 33 to the toner container 50.

Figure 11A:
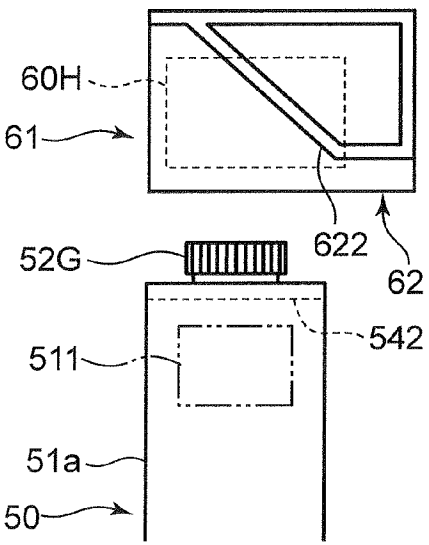
FIGS. 11A to 11C are diagrams of the developing device and the toner container showing a process of assembling the toner container with the developing device.
Figure 11B:
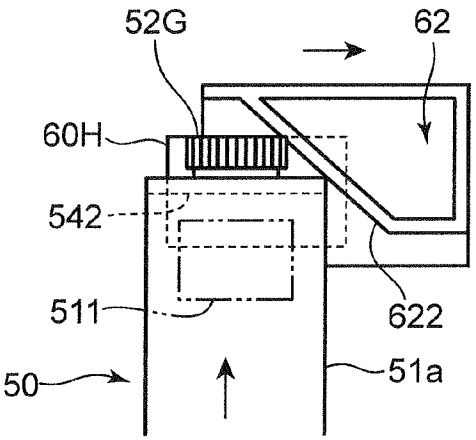
Figure 11C:
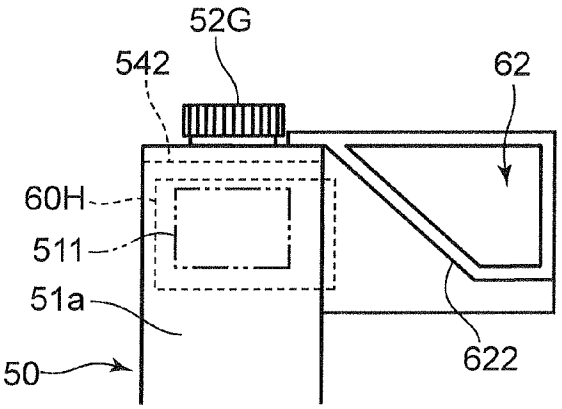

On the other hand, when the cylindrical portion 51*b* of the toner container 50 is inserted into the container mounting portion 61 from the front side to the rear side, the first pressing plate 542 of the toner container 50 interferes with the developer shutter plate 62 arranged at the closing position to move the developer shutter plate 62 rightward. Specifically, as shown in FIGS. 11A and 11B, the first pressing plate 542 comes into contact with the oblique elongated projection 623 projecting on the upper surface of the developer shutter plate 62 to push the developer shutter plate 62 rightward against the biasing force of the biasing spring 625. When the toner container 50 is inserted to the predetermined assembled position (FIG. 11C), the developer shutter plate 62 reaches the opening position to open the toner supply opening 60H and the toner discharge opening 511 of the toner container 50 faces the toner supply opening 60H, whereby the toner can be supplied from the toner container 50 to the developing device 33. Note that although not shown, the toner container 50 includes a shutter member for opening and closing the toner discharge opening 511, and this shutter member is pushed forward by the projection 613 formed on the guiding portion 612 to thereby open the toner discharge opening 511 as the cylindrical portion 51*b* of the toner container 50 is inserted from the front side to the rear side in mounting the toner container 50.

On the other hand, when the toner container 50 is removed from the container mounting portion 61, the developer shutter plate 62 returns to the closing position by the biasing force of the biasing spring 625, thereby closing the toner supply opening 60H.

As described above, according to this image forming apparatus 1, the toner supply opening 60H can be opened and closed as the toner container 50 is mounted to and removed from the developing device 33. Particularly, since the toner supply opening 60H is opened and closed by displacing the developer shutter plate 62 in the lateral direction, i.e. direction perpendicular to the assembling direction of the toner container (direction parallel to the axial direction of the developing roller 331) in this embodiment, the amount of displacement of the developer shutter plate 62 is less subject to restriction as compared with the case where the developer shutter plate 62 is displaced in forward and backward directions. Specifically, in the case of displacing the developer shutter plate 62 in forward and backward directions, the amount of displacement of the developer shutter plate 62 is restricted by the presence of the photosensitive drum 31. However, this embodiment is free from such a restriction. Thus, a large displacement margin can be ensured for the developer shutter plate 62, whereby the toner can be smoothly supplied from the toner container 50 to the developing device 33 by making the toner supply opening 60H relatively large.

In addition, in this image forming apparatus 1, the developer shutter plate 62 is displaced along the guide groove 611 of the developer housing 60 by bringing the first pressing plate 542 assembled with the toner container 50 into contact with the oblique elongated projection 622 formed on the developer housing 60 as the toner container 50 is assembled. Thus, there is an advantage of being able to enjoy functions and effects as described above by a very simple construction.

Although the image forming apparatus 1 according to the embodiment of the present disclosure has been described above, the following modifications can be, for example, made without being limited to this.

(1) Although the developer shutter plate 62 is moved by bringing the oblique elongated projection 622 formed on the developer shutter plate 62 into contact with the first pressing plate 542 of the toner container 50 in the above embodiment, an end surface (left end surface) of the developer shutter plate 62 itself may be formed into an oblique surface inclined with respect to forward and backward directions and the first pressing plate 542 of the toner container 50 may be brought into contact with this oblique surface.

Further, a plate having an oblique surface corresponding to the oblique elongated projection 622 (parallel to the oblique elongated projection 622) may be mounted as the first pressing plate 542 and the oblique elongated projection 622 and the first pressing plate 542 may come into surface contact. According to this construction, the oblique elongated projection 622 can be displaced while being smoothly pressed by the first pressing plate 542.

Furthermore, the relationship between the developer shutter plate 62 and the toner container 50 in the above embodiment may be reversed. That is, a plate formed, for example, with a shaft-like projection instead of the oblique elongated projection 622 may be applied as the developer shutter plate 62 and, on the other hand, a plate formed with an oblique surface inclined with respect to forward and backward directions may be applied as the first pressing plate 542 and the developer shutter plate 62 may be displaced by bringing the oblique surface of the first pressing plate 542 and the shaft-like projection of the developer shutter plate 62 into contact with each other.

(2) In the above embodiment, the toner supply opening 60H is opened by bringing the oblique elongated projection 622 formed on the developer shutter plate 62 into contact with the first pressing plate 542 of the toner container 50 after the developer shutter plate 62 is so held on the developer housing 60 as to be movable in the lateral direction. However, a mechanism for opening and closing the toner supply opening 60H may be something other than the one in the above embodiment provided that it can translate a movement of the toner container 50 in forward and backward directions into a movement of the developer shutter plate 62 in the lateral direction.

(3) Although the toner supply opening 60H is formed at a position of the developing device 33 close to the left end of the developing device 33 and opened by displacing the developer shutter plate 62 toward the right side of the developing device 33 in the above embodiment, it may be provided in an intermediate part of the developing device 33 in the lateral direction. However, if the toner supply opening 60H is provided at a position closer to one end (left end) than the intermediate part of the developing device 33 in the lateral direction and the developer shutter plate 62 is displaced toward the other end (right end) as in the above embodiment, a large displacement margin can be ensured for the developer shutter plate 62. Therefore, as compared with the case where the toner supply opening 60H is provided in the intermediate part in the lateral direction, there is an advantage of being able to make the toner supply opening 60H larger in the lateral direction.

(4) Although the toner container 50 is shaped to be long and narrow in forward and backward directions in a state mounted to the developing device 33 and conveys the toner to the toner discharge opening 511 by the conveying screw 52 arranged therein and extending in forward and backward directions in the above embodiment, the specific construction of the toner container is not limited to this. For example, the toner container 50 may include a container main body extending in parallel to the developing roller and a conveying screw arranged therein and extending in a longitudinal direction of the container main body and guide the toner to a toner discharge opening formed at a specific position of the container main body in the longitudinal direction while conveying the toner in an axial direction thereof by the rotation of this conveying screw.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising an image bearing member for bearing a toner image on a circumferential surface, a developing device including a developing roller for supplying toner to the circumferential surface of the image bearing member, and a toner container to be removably assembled with the developing device for supplying toner to the developing device, wherein:

the toner container includes a container main body provided with a toner discharge opening at a predetermined position, a conveying screw for conveying toner stored in the container main body to the toner discharge opening and a container shutter member for opening and closing the toner discharge opening, and the toner container is assembled with the developing device along an assembling direction that is parallel to an axial direction of the conveying screw and is perpendicular to an axial direction of the developing roller, assembly of the toner container with the developing device along the assembling direction causing the container shutter member to move relative to the toner container in a direction parallel to the conveying screw and opposite to the assembling direction, thereby opening the toner discharge opening;

the developing device includes:

a housing main body in which the developing roller is housed and which includes a toner supply opening for receiving the toner from the toner container, a container mounting portion which is arranged on the housing main body and on which the toner container is to be mounted, a developer shutter member which is so held on the housing main body as to be displaceable in a direction parallel to the axial direction of the developing roller and is displaceable to a first position for closing the toner supply opening and a second position for opening the toner supply opening, and a biasing member which biases the developer shutter member to the first position;

the container main body includes a container side first contact portion, the developer shutter member includes a shutter member side contact portion and the container side first contact portion comes into contact with the shutter member side contact portion in a mounting process of mounting the toner container to the container mounting portion of the developing device; and the container side first contact portion and the shutter member side contact portion are formed to displace the developer shutter member from the first position to the second position against a biasing force of the biasing member as the toner container moves in the assembling direction in the mounting process.

2. An image forming apparatus according to claim 1, wherein;

at least one of the container side first contact portion and the shutter member side contact portion includes an oblique surface which serves as a contact surface with which the other contact portion comes into contact and is inclined with respect to the assembling direction; and the oblique surface is formed to translate a pushing force of the toner container into a force for displacing the shutter member from the first position to the second position in the mounting process.

3. An image forming apparatus according to claim 2, wherein:

the container main body further includes a conveying screw for supplying the toner inside to the developing device and a container gear provided at the leading end of the conveying screw;

the developing device includes a gear holder;

the gear holder includes an output gear engageable with the container gear; and the gear holder is set switchable between an engaged position where the output gear and the container gear are engaged and a retracted position retracted from the engaged position.

4. An image forming apparatus according to claim 3, wherein:

a gear holder biasing member for biasing the gear holder in such a direction that the gear holder is at the engaged position in a normal state is disposed in the gear holder;

the gear holder is formed with a gear holder side contact portion and the container main body is formed with a container side second contact portion which comes into contact with the gear holder side contact portion in the mounting process of mounting the toner container to the container mounting portion of the developing device;

the gear holder side contact portion and the container side second contact portion displace the gear holder from the engaged position to the retracted position against a biasing force of the gear holder biasing member as the toner container moves in the assembling direction in the mounting process; and the gear holder is returned to the engaged position when the mounting process is completed.

5. An image forming apparatus according to claim 1, wherein:

the developing device includes the toner supply opening at a position closer to one end than an intermediate part in the axial direction of the developing roller; and the shutter member reaches the second position when being displaced to a side opposite to the one end in the axial direction.

6. A toner container configured to supply toner to a developing device including a developing roller for supplying toner to a circumferential surface of an image bearing member bearing a toner image on the circumferential surface, the toner container being removably mountable to the developing device, the developing device including:

a housing main body which includes a container mounting portion on which the toner container is to be mounted, and a toner supply opening for receiving the toner from the toner container mounted to the container mounting portion;

a developer shutter member which is so held on the housing main body as to be displaceable in a direction parallel to the axial direction of the developing roller and is displaceable to a first position for closing the toner supply opening and a second position for opening the toner supply opening; and a biasing member which biases the developer shutter member to the first position;

the toner container, comprising:

a container main body in which toner is contained and which is provided with a toner discharge opening through which the toner is to be supplied to the developing device, a conveying screw for conveying toner stored in the container main body to the toner discharge opening, and a container shutter member for opening and closing the toner discharge opening, wherein:

the toner container is assembled with the developing device along an assembling direction that is parallel to an axial direction of the conveying screw and perpendicular to an axial direction of the developing roller, assembly of the toner container with the developing device along the assembling direction causing the container shutter member to move relative to the toner container in a direction parallel to the conveying screw and opposite to the assembling direction, thereby opening the toner discharge opening, the container main body includes a contact portion which comes into contact with the developer shutter member in a mounting process of mounting the toner container to the container mounting portion; and the contact portion is formed to displace the developer shutter member from the first position to the second position against a biasing force of the biasing member as the toner container moves in the assembling direction in the mounting process.

* * * * *